US012514416B2

(12) United States Patent
Dyson et al.

(10) Patent No.: US 12,514,416 B2
(45) Date of Patent: Jan. 6, 2026

(54) FILTER ARRANGEMENT FOR A VACUUM CLEANING APPLIANCE

(71) Applicant: Dyson Technology Limited, Wiltshire (GB)

(72) Inventors: Jacob Dyson, Bath (GB); Mark Timothy Shaddick, Bristol (GB); Karl Alan Jolly, Malmesbury (GB); Ketan Patel, Swindon (GB); Taylor Teck Hui Lim, Johor (MY); Jeremy William Crouch, Swindon (GB); Miles Sinclair Quance, Bradford-On-Avon (GB)

(73) Assignee: Dyson Technology Limited, Wiltshire (GB)

( * ) Notice: Subject to any disclaimer, the term of this patent is extended or adjusted under 35 U.S.C. 154(b) by 367 days.

(21) Appl. No.: 18/273,496

(22) PCT Filed: Dec. 14, 2021

(86) PCT No.: PCT/GB2021/053271

§ 371 (c)(1),
(2) Date: Jul. 20, 2023

(87) PCT Pub. No.: WO2022/157469

PCT Pub. Date: Jul. 28, 2022

(65) Prior Publication Data

US 2024/0122427 A1 Apr. 18, 2024

(30) Foreign Application Priority Data

Jan. 22, 2021 (GB) ..... 2100847

(51) Int. Cl.
*A47L 9/14* (2006.01)
*A47L 9/12* (2006.01)
*A47L 9/20* (2006.01)

(52) U.S. Cl.
CPC ..... *A47L 9/1463* (2013.01); *A47L 9/127* (2013.01); *A47L 9/20* (2013.01); *A47L 2201/00* (2013.01)

(58) Field of Classification Search
CPC ..... A47L 9/1463; A47L 9/127; A47L 9/20; A47L 2201/00
See application file for complete search history.

(56) References Cited

U.S. PATENT DOCUMENTS 6,511,531 B1 1/2003 Cartellone
2004/0074042 A1 4/2004 Overvaag
(Continued)

FOREIGN PATENT DOCUMENTS

CN 106895491 A1 6/2017
CN 209263249 U 8/2019
(Continued)

OTHER PUBLICATIONS

International Search Report and Written Opinion received for PCT Patent Application No. PCT/GB2021/053271, mailed on Mar. 22, 2022, 9 pages.
(Continued)

*Primary Examiner* — Andrew A Horton
(74) *Attorney, Agent, or Firm* — Tucker Ellis LLP; Michael G. Craig

(57) ABSTRACT

A filter arrangement for a vacuum cleaning appliance includes: a filter enclosure having an enclosure opening; a filter configured to be received through the enclosure opening into the filter enclosure in an insertion direction; and retention means operable between latched and unlatched states for releasably retaining the filter in the filter enclosure. The filter includes an actuation portion configured to operate the retention means, wherein the actuation portion is moveable between at least first and second positions and is biased towards the second position. When the filter is in the filter enclosure, movement of the actuation portion in the insertion direction from the first position to a depressed position transitions the retention means to the unlatched state, whereinafter the actuation portion is moved to the second position
(Continued)

in which at least a part of the actuation portion is elevated above the enclosure opening.

16 Claims, 10 Drawing Sheets

(56) References Cited

U.S. PATENT DOCUMENTS

| | | | |
|---|---|---|---|
| 2005/0138762 | A1 | 6/2005 | West |
| 2006/0277712 | A1 | 12/2006 | Kim et al. |
| 2008/0115315 | A1 | 5/2008 | White et al. |
| 2019/0038104 | A1 | 2/2019 | Jang et al. |

FOREIGN PATENT DOCUMENTS

| | | | |
|---|---|---|---|
| EP | 1922970 | A2 | 5/2008 |
| GB | 2400309 | A | 10/2004 |
| GB | 2417888 | A | 3/2006 |
| JP | H02-140525 | A | 5/1990 |
| KR | 10-0726947 | B1 | 6/2007 |

OTHER PUBLICATIONS

Szetosy, 2017, '6X Touch Release Catch for Cupboard', Amazon.co.uk, [online], Available from: https://www.amazon.co.uk/Cupboard-Touch-Release-Latch-GOODCHANCEUK/dp/B06Y6G7YBX/ref=sr_1_37?dchild=1&keywords=Push+Door+Catches&qid=1625229831&sr=8-37 [Accessed Jul. 5, 2021}.

FILTER ARRANGEMENT FOR A VACUUM CLEANING APPLIANCE

CROSS-REFERENCE TO PRIOR APPLICATION

This application is a § 371 National Stage Application of PCT International Application No. PCT/GB2021/053271 filed Dec. 14, 2021, which claims the priority of United Kingdom Application No. 2100847.9, filed Jan. 22, 2021, each of which are herein incorporated by reference in their entirety.

TECHNICAL FIELD

The invention relates generally to a filter arrangement, and particularly to a filter arrangement for a vacuum cleaning appliance.

BACKGROUND

A vacuum cleaning appliance or, more simply, "vacuum cleaner", typically comprises a main body which is equipped with a suction motor, a dust separator, and a cleaner head connected to the dust separator usually by a separable coupling. The dust separator is the main mechanism by which the vacuum cleaner removes dirt and debris from the airflow through the machine, and this applies whether the dust separator relies on a cyclonic separation system or otherwise.

Although dust separators are generally very efficient at removing dirt and debris from the airflow, fine particles remain in the airflow that exits the dust separator and travels towards the suction motor. It is important that the suction motor is protected from these fine particles as they can be potentially damaging to some of its components. It is also important to make the exhaust airflow that is discharged from the vacuum cleaner as clean as possible, and to this end it is desirable to conform to HEPA standard filtration, as would be well-known to those skilled in this technical field.

Typically, a vacuum cleaner includes two filters: a first filter, also called a "pre-motor filter" or "pre-filter" which is located in the airflow through the machine downstream of the dust separator but upstream of the suction motor; and a second filter, also called a "post-motor filter" or "post-filter" that is located in the airflow downstream of the suction motor, before the airflow exhausts from the machine. Incorporating two filters into a vacuum cleaner can challenge packaging constraints, as well as making the machine larger and heavier. What is more, although it is usually recommended that both filters are washed frequently, filter washing typically is carried out less often than directed, which may be due, at least partly, to the additional inconvenience in having to find and remove two filters from the machine.

It has been attempted to combine pre- and post-filters into a single package to address packaging issues and to make filter removal and replacement more convenient. However, incorporating such combined filter packages in a vacuum cleaner in a way that is readily accessible, space efficient, ergonomic and yet unobtrusive can present a challenge.

It is against this background that the invention has been devised.

SUMMARY OF THE INVENTION

According to a first aspect of the invention, there is provided a filter arrangement for a vacuum cleaning appliance, comprising: a filter enclosure having an enclosure opening; a filter configured to be received through the enclosure opening into the filter enclosure in an insertion direction; and retention means operable between latched and unlatched states for releasably retaining the filter in the filter enclosure, wherein the filter includes an actuation portion configured to operate the retention means, wherein the actuation portion is moveable between at least first and second positions and is biased towards the second position, wherein, when the filter is in the filter enclosure, movement of the actuation portion in the insertion direction from the first position to a depressed position transitions the retention means to the unlatched state, whereinafter the actuation portion is moved to the second position in which at least a part of the actuation portion is elevated above the enclosure opening.

An arrangement according to the invention advantageously permits easy removal of the filter from the filter enclosure. By simply moving the actuation portion in the insertion direction from the first to the depressed position, the retention means is transitioned to the unlatched state, and the actuation portion is biased into the second position. The required movement of the actuation portion is therefore straightforward and intuitive. In this elevated second position, a user is able to gain a purchase on, or grasp, the actuation portion, for removal. The filter can therefore be extracted from the filter enclosure in a small number of simple steps, when washing or other maintenance activities are required, for example.

Optionally, when the filter is in the filter enclosure, movement of the actuation portion in the insertion direction from the second position to the depressed position transitions the retention means to the latched state, whereinafter the actuation portion may be moved into the first position. Advantageously, the movement for transitioning the retention means to the latched state may therefore be the same as the movement for transitioning the retention means to the unlatched state. This further increases the simplicity of the arrangement, and the ease with which a filter can be inserted and removed from the filter enclosure.

Optionally substantially all, or the whole, of the actuation portion is elevated above the enclosure opening when the actuation portion is in the second position. The actuation portion may be spaced apart from the enclosure opening when the actuation portion is in the second position. In this way, the user is able to grip the sides and/or the base of the actuation portion for removal, increasing the ease of handling of the actuation portion.

The actuation portion may close the enclosure opening when in the first position. This feature has the advantage that the actuation portion has a dual-function, both sealing the filter in the filter enclosure and causing latching or unlatching of the retention means. This additionally reduces the number of component parts, increasing the simplicity of the arrangement and the ease of use. The first position may correspond to a stowed position, while the second position may correspond to an elevated, or removal position. An upper surface of the actuation portion may be substantially level with the enclosure opening when the actuation portion is in the first position.

The filter may further include a filter body, and the actuation portion may be movable relative to the filter body. Advantageously, this means that the filter body itself does not need to be moved to transition the retention means to an unlatched or to a latched state, and that this unlatching or latching can be effected by a separate component. The first and second positions may be positions of the actuation portion relative to the filter body.

The actuation portion may be biased away from and/or relative to the filter body, towards the second position. This feature has the advantage that the actuation portion is advantageously urged away from the filter body and into the second position when the retention means transitions to the unlatched state, or into the first position when the retention means transitions to the latched state, without input being required from the user. In addition, the actuation portion is advantageously urged into the second position irrespective of whether the filter is in the filter enclosure. Such an arrangement is relatively simple, and does not require the filter to be in position in the filter enclosure before the actuation portion is biased into the second position.

The actuation portion may be biased by a biasing means. The biasing means may be positioned intermediate the filter body and the actuation portion. The biasing means optionally comprises a torsion spring, a tension spring, a compression spring, a magnetic device or an elastomeric member, or a combination thereof.

Movement of the actuation portion relative to the filter body may cause operation of the retention means, such that the retention means transitions to the unlatched or to the latched state.

The retention means may include a first latching mechanism associated with the actuation portion and a second latching mechanism associated with the filter body. Advantageously, the provision of a latching mechanism for each of the actuation portion and the filter body means that the filter is securely retained in the filter enclosure when the retention means is in the latched state, and provides a level of redundancy. The latched state of the retention means may be a state in which each of the first and second latching mechanisms is in a respective latched state, while the unlatched state of the retention means may be a state in which each of the first and second latching mechanisms is in a respective unlatched state. The provision of two latching mechanisms may additionally mean that there are one or more intermediate states between the latched state and the unlatched state of the retention means, when the first latching mechanism is unlatched and the second is latched, for example.

The first latching mechanism may include a two-state latching mechanism which is activated by movement of the actuation portion relative to the filter body between the first position and the depressed position. The two-state latching mechanism may comprise a protrusion, or activation pin, and a receiving portion configured to be activated by and/or to receive the activation pin. The protrusion and receiving portion may be mounted to a respective one of the actuation portion and the filter enclosure. As such, movement of the actuation portion relative to the filter body from the first position to the depressed position may advantageously cause activation of the first latching mechanism, disengaging the actuation portion from the filter enclosure.

The second latching mechanism may include a latch member carried on the filter body which is engageable with the filter enclosure. Movement of the actuation portion relative to the filter body between the first position and second position may cause movement of the latch member. Conveniently, the latch member may be a latch bolt.

For example, movement of the actuation portion relative to the filter body from the first position to the second position may cause the latch member to move out of engagement with the filter enclosure, and may cause retraction of the latch member towards the filter body. Movement of the actuation portion relative to the filter body from the second position to the first position may cause extension or movement of the latch member into engagement with the filter enclosure, and may cause the latch member to move away from the filter body. Movement of the actuation portion relative to the filter body from the first position and/or the second position to the depressed position optionally causes extension of the latch member into engagement with the filter enclosure.

Optionally, the latch member is biased out of engagement with the filter enclosure. Advantageously, this means that the latch member is biased into a position in which the second latching mechanism is in an unlatched state. In this way, once any external force applied to the latching mechanism by way of the actuation portion has been removed, the latch member retracts and the filter body can be removed from the filter enclosure without resistance.

Movement of the latch member may be in a direction that is transverse to the movement of the actuation portion. Optionally, movement of the latch member is in a direction that is substantially perpendicular to the movement of the actuation portion. Movement of the latch member may be in a direction that is transverse to the movement of the actuation portion in the insertion direction.

The filter may comprise alignment means configured to guide the movement of the actuation portion relative to the filter body. Advantageously, this means that the movement and orientation of the actuation portion relative to the filter body is controlled, and that the actuation portion is only permitted to move relative to the filter body in the insertion direction and a direction opposite thereto. Undesirable relative translational or rotational movement between the two parts is therefore mitigated against. The alignment means may comprise one or more protrusions and one or more openings, each of the one or more protrusions being received by a corresponding one of the one or more openings. The one or more protrusions may be elongate members or rods, and each of the openings may be complementary elongate openings, wherein each member and/or opening optionally extends in the insertion direction.

The actuation portion may have a plan profile that substantially corresponds to a plan profile of the filter body. Such an arrangement is advantageously relatively compact, while providing an actuation portion having a relatively large surface area for depression. The actuation portion may comprise a plate-shaped member. Optionally, the actuation portion is a closure plate or lid.

The actuation portion may be suspended, or moveably suspended, relative to the filter body by a load-equalising mechanism. The load-equalising mechanism may be configured to maintain the orientation of the actuation portion relative to the filter body during movement of the actuation portion. Such a load-equalising mechanism advantageously permits a user to apply a load at any point on the actuation portion and for the entire actuation portion to move uniformly in the insertion direction, maintaining the orientation of the actuation portion relative to the filter body. The load-equalising mechanism therefore increases the ease of use of the filter arrangement, and the ease of removal of the filter from the filter enclosure, since a user is not required to apply pressure at a specific point on the actuation portion.

The load-equalising mechanism may comprise a pair of torque arms, a first torque arm of the pair optionally being transverse to a second torque arm of the pair. As such, the torque arms may spread, or equalise, an applied load in different directions. The first torque arm may be perpendicular to the second torque arm.

The first and second torque arms may each be pivotably mounted to at least one of the actuation portion and the filter body, and may each be in sliding communication with at least one of the actuation portion and the filter body. The actuation portion or the filter body may comprise a pair of elongate tracks, each elongate track being configured to receive a respective one of the first torque arm and the second torque arm.

Optionally, the filter and the filter enclosure define a keyway arrangement such that the filter may only be received into the filter enclosure in a single orientation. Such an arrangement increases the ease of insertion of the filter into the filter enclosure, guarding against incorrect insertion and ensuring that the filter is positioned in the filter enclosure in the orientation in which it can operate successfully.

Optionally, the enclosure opening has a central longitudinal axis substantially perpendicular to the insertion direction, the keyway arrangement being offset from the central longitudinal axis at the enclosure opening when the filter is in the filter enclosure. Optionally, the keyway arrangement comprises at least one protrusion and at least one recess, each protrusion optionally being received by a respective recess when the filter is received into the filter enclosure. Each protrusion may be an elongate rib, and each recess may be an elongate channel, wherein each elongate rib and each elongate channel optionally extends in the insertion direction. The at least one recess may extend from the enclosure opening into the filter enclosure, wherein a width of each recess in a direction substantially perpendicular to the insertion direction may be at a maximum at a first end of the recess corresponding to the enclosure opening. Each recess may be tapered at a first end of the recess corresponding to the enclosure opening. Such a feature further increases the ease with which the filter can be inserted into the filter enclosure.

The filter may comprise an angled side, or side wall, the angled side being at a transverse angle to the insertion direction when the filter is in the filter enclosure. The filter enclosure may comprise a flexible side wall biased towards the filter to support the filter in the filter enclosure. The flexible side wall may engage a side, or side wall, of the filter when the filter is received into the filter enclosure. The filter may comprise a filter body, and the filter body and the filter enclosure may define the keyway arrangement.

Optionally, the filter comprises a first filter and a second filter. The first filter and the second filter may be annular about a common axis and the first and second filters are typically concentrically arranged. Advantageously, in such a configuration the first and second filters take a compact arrangement, reducing the space required by the filters in the vacuum cleaning appliance, freeing up space for other components and increasing the ease with which the filters can be packaged and housed in the appliance.

The first filter is optionally positioned radially outward of the second filter, in a direction perpendicular to the common axis. Typically, the first filter is a pre-motor filter and the second filter is a post-motor filter. When the pre-motor filter is positioned radially outwardly of the post-motor filter, this has the advantage that the filter that is required to filter the more heavily dust and dirt-laden air has the larger surface area, increasing the effectiveness of the vacuum cleaning appliance and increasing the time that elapses before the filters need washing or maintenance.

The first and second filters may be housed within and/or configured to engage with the actuation means. The first and second filters are optionally moveable relative to the actuation means, to disengage the first and second filters therefrom. The first and second filters may be housed within and/or configured to engage with the filter body. The first and second filters are optionally moveable relative to the filter body, to disengage the first and second filters therefrom.

The first and second filters may be coupled so as to be moveable as a single unit. The first and second filters may be coupled to a gripping means, for gripping the first and second filters during movement thereof. Such a feature increases the ease of handling and manipulation of the first and second filters, during maintenance activities for example.

The first filter may overlap with the second filter in a direction parallel to the common axis. The cross sectional shape of one or both of the first and second filters in a plane perpendicular to the common axis may be one of circular, elliptical or obround.

In another aspect of the invention, there is provided a vacuum cleaning appliance comprising a filter arrangement in accordance with a previous aspect of the invention.

Within the scope of this application it is expressly intended that the various aspects, embodiments, examples and alternatives set out in the preceding paragraphs, in the claims and/or in the following description and drawings, and in particular the individual features thereof, may be taken independently or in any combination. That is, all embodiments and/or features of any embodiment can be combined in any way and/or combination, unless such features are incompatible. The applicant reserves the right to change any originally filed claim or file any new claim accordingly, including the right to amend any originally filed claim to depend from and/or incorporate any feature of any other claim although not originally claimed in that manner.

BRIEF DESCRIPTION OF THE DRAWINGS

The above and other aspects of the invention will now be described, by way of example only, with reference to the accompanying drawings, in which.

Figure 1:
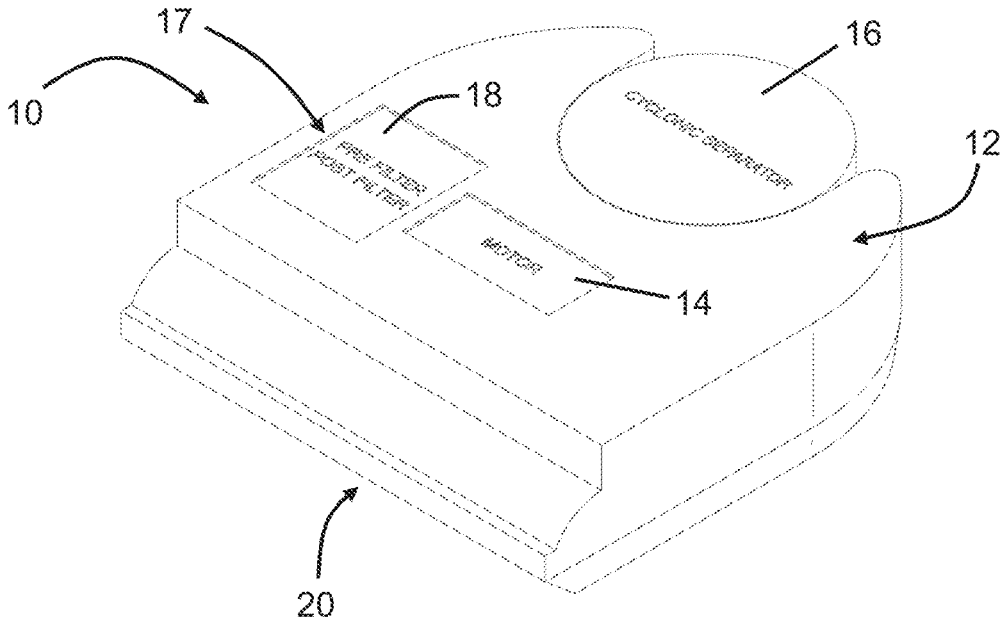
FIG. 1 is a schematic perspective view of a vacuum cleaning appliance comprising a filter arrangement in accordance with an embodiment of the invention.

In the drawings, like features are denoted by like reference signs.

SPECIFIC DESCRIPTION

A specific embodiment of the invention will now be described in which numerous features will be discussed in detail in order to provide a thorough understanding of the inventive concept as defined in the appended claims. However, it will be apparent to the skilled person that the invention may be put in to effect without the specific details and that in some instances, well known methods, techniques and structures have not been described in detail in order not to obscure the invention unnecessarily. Moreover, references in the following description to "left", "right", "front", "rear" and any other terms having an implied orientation, such as "vertical" and "horizontal" are not intended to be limiting, and refer only to the orientation of the features as shown in the accompanying drawings.

FIG. 1 shows a vacuum cleaning appliance or vacuum cleaner 10 comprising a main body 12, a suction motor 14, a dirt and dust separator 16, a filter arrangement 17 having a filter 18, and a cleaner head 20 connected to the dust separator 16. In use, the suction motor 14 draws dirt-laden air from a surface to be cleaned through the cleaner head 20 and into the dirt and dust separator 16. The dirt and dust separator 16 separates dirt and debris from the dirt-laden air drawn in through the cleaner head 20, before the air is expelled into the filter 18 for removal of smaller dirt and dust particles. The filter 18 itself comprises a first, pre-motor filter 18*a* (shown in FIG. 7) and a second, post-motor filter 18*b* (not shown in FIG. 7), situated upstream and downstream of the suction motor 14, respectively. After passing through the pre-motor filter 18*a*, the suction motor 14 and the post-motor filter 18*b*, the cleaned air is then expelled from the vacuum cleaner 10 into the atmosphere.

The dirt and dust separator 16 shown in this example is a cyclonic separating unit, but it will be appreciated by the skilled person that the separator 16 may take any one of a number of suitable forms, and that the cyclonic separating unit 16 may be replaced with an alternative separating unit or combination of separating units. In addition, in the described arrangement, the vacuum cleaner 10 takes the form of a robot vacuum cleaner. However, it will be appreciated that the filter arrangement 17 described herein may be used with other types of vacuum cleaners such as, for example, upright or stick vacuum cleaners.

Turning to FIGS. 2 to 4B, the filter arrangement 17 will now be described. The filter arrangement 17 comprises a filter enclosure 22 extending into the main body 12 of the vacuum cleaner 10 and defining an enclosure opening 24 at an upper surface 12*a* of the main body 12, such that the upper surface 12*a* and enclosure opening 24 lie in substantially the same plane. The filter 18 is configured to be received through the enclosure opening 24 and into the filter enclosure 22 in an insertion direction I (shown in FIG. 8), which, in the described arrangement, is substantially vertical. It will be appreciated that the insertion direction I will depend on the specific arrangement of the filter 18 and filter enclosure 22 and may therefore take another orientation. A removal direction of the filter 18 is substantially opposite to the insertion direction I.

In use of the vacuum cleaner 10, the filter 18 is housed and retained in the filter enclosure 22. However, it is recommended that pre- and post-motor filters 18*a*, 18*b* are washed at regular intervals, to remove dirt and dust particles that have built up on their component parts over time, and it is desirable for the filter 18 to be removable from the filter enclosure 22 for this purpose. To this end, the filter arrangement 17 also comprises a retention means 26 operable between latched and unlatched states for releasably retaining the filter 18 in the filter enclosure 22, such that the filter 18 may be held in the filter enclosure 22, or released for handling by a user when washing or other maintenance activities are necessary.

In the described arrangement, the filter 18 includes a filter body 28 and an actuation portion 30 mounted to the filter body 28. The actuation portion 30 is configured to operate the retention means 26, and is moveable relative to the filter body 28 between at least a relatively low first position and a relatively high second position. The actuation portion 30 takes the form of a closure plate and closes the enclosure opening 24 when in the first position, sitting substantially flush, or level, with the upper surface 12*a* of the main body 12. The closure plate 30 is in this first position during normal operation of the vacuum cleaner 10.

When the filter 18 is in the filter enclosure 22, movement of the actuation portion 30 in the insertion direction I from the first position to a depressed position transitions the retention means 26 to the unlatched state so that the closure plate 30 is biased towards the second position. Upon this transition, the closure plate 30 is urged, or moved, into the second position. In this second position, the closure plate 30 is elevated above, and is spaced apart from the enclosure opening 24. From this position, subsequent movement of the actuation portion 30 in the insertion direction I to the depressed position transitions the retention means 26 to the latched state, and the closure plate is urged, or moved, into the first position.

While the actuation portion 30 is described herein as being a separate part to the filter body 28, the skilled person will appreciate that the actuation portion 30 may alternatively be integral with the filter body 28. In other words, the filter body 28 may itself be configured to operate the retention means 26 and can be moveable between at least first and second positions, in the manner described above.

The filter body 28 and closure plate 30 will now be described in more detail, with reference to FIGS. 4A to 6.

The filter body 28 is substantially rectangular in plan profile, comprising front, rear, left-hand and right-hand sides 32, 34, 36, 38. The pre- and post-motor filter 18*a*, 18*b* are each housed within the filter body 28, and the front 32 and rear 34 sides of the filter body 28 curve inwardly, towards one another, following the shape of the filters. To permit air flowing out of the cyclonic separating unit 16 to enter the filter body 28 for filtering by the pre- and post-motor filters 18*a*, 18*b*, the rear 34 of the filter body 28 defines a filter inlet opening 40.

The left-hand side 36 of the filter body 28 is generally vertical, and is substantially parallel with the insertion direction I when the filter body 28 is in place in the filter enclosure 22. In contrast, the right-hand side 38 of the filter body 28 is angled, sloping inwardly towards the left-hand side wall. As such, the right-hand side 38 is at a transverse angle to the insertion direction I when the filter 18 is in the filter enclosure 22. In practice, the sloping right-hand side 38 of the filter body 28 advantageously assists with smooth insertion of the filter 18 into the filter enclosure 22, guarding against the filter body 28 catching, or snagging, against an edge of the enclosure 22.

The closure plate 30 has a plan profile that broadly corresponds to the rectangular plan profile of the filter body 28, and is elevated above and spaced apart from the filter body 28 in both the first and second position. In particular, the closure plate 30 is suspended directly above the filter body 28 by way of both a load-equalising mechanism 42 and a biasing means 44 positioned intermediate the filter body 28 and closure plate 30. The load-equalising mechanism 42 is configured to maintain the orientation of the closure plate 30 relative to the filter body 28 during movement of the closure plate 30, while the primary purpose of the biasing means is to bias the closure plate 30 away from the filter body 28.

The biasing means is in the form of a compression spring 44, coupled at a lower end to an upper side of the filter body 28 and at an upper end to an underside of the closure plate 30, opposing the filter body 28. The compression spring 44 urges the closure plate 30 into the second position, in which the spring 44 is neither in tension nor compression. The closure plate has a central longitudinal axis A, substantially perpendicular to the insertion direction I when the filter 18 is in the filter enclosure 22 and, in the depicted arrangement, the spring 44 is positioned along this central longitudinal axis A, towards a front end of the closure plate 30. It will be appreciated that the spring may take any one of a number of suitable positions, and that the arrangement may alternatively comprise two springs each positioned either end of the closure plate 30, or four springs positioned at respective corners of the closure plate 30, for example.

Figure 5:
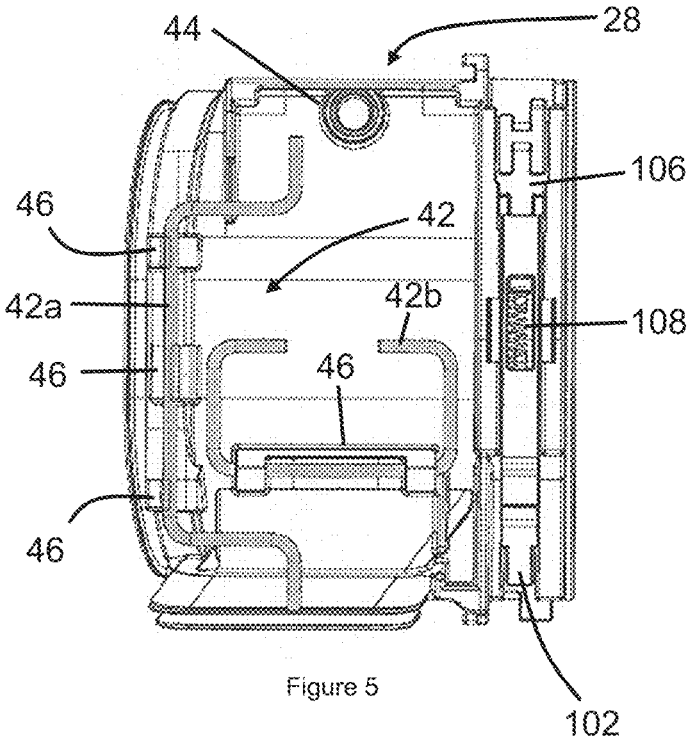
FIG. 5 is a plan view of a filter body of the filter of FIGS. 4A and 4B.

As shown in FIG. 5, the load-equalising mechanism 42 takes the form of a pair of torque arms 42*a*, 42*b* mounted to the upper side of the filter body 28. A first torque arm 42*a* of the pair is longer than, and substantially perpendicular to, a second torque arm 42*b* of the pair, such that a central longitudinal axis of an elongate portion of the first torque arm 42*a* is perpendicular to a central longitudinal axis of a corresponding elongate portion of the second torque arm 42*b*. The first torque arm 42*a* extends from front to rear along the length of the filter body 28, while the second torque arm 42*b* extends across the filter body 28 from left to right. The elongate portion of each torque arm is received by a complimentary mount 46 on the filter body 28, and is permitted to rotate about its central longitudinal axis, in a hinge-type arrangement. While each torque arm 42*a*, 42*b* is therefore free to pivot in its respective mount 46, the connection between the torque arm and the mount 46 is relatively tight, to avoid undesirable relative translational movement, or 'rattling', therebetween.

The underside of the closure plate 30, opposing the upper side of the filter body 28, is provided with four elongate tracks (not shown). The ends of each torque arm 42*a*, 42*b* remote from their respective mounts 46 are received in respective tracks, such that the torque arms 42*a*, 42*b* are in sliding communication with the closure plate 30. It will be apparent to the skilled person that the sliding direction of the first torque arm 42*a* relative to the closure plate 30 is substantially perpendicular to the sliding direction of the second torque arm 42*b* relative to the closure plate 30.

In practice, when pressure is applied at any point on the closure plate 30 to move the closure plate 30 towards the filter body 28, the torque bars 42*a*, 42*b* ensure that the entire closure plate 30 moves in a uniform manner. In other words, in the event that a user presses down on a corner of the closure plate 30 when it is in position in the filter enclosure 22, the entire closure plate 30 moves downwardly towards the filter body 28, and the attitude of the closure plate 30 relative to the filter body 28 is maintained.

The load-equalising mechanism 42 may itself also have a biasing function, to bias the closure plate 30 away from the filter body 28. For example, a spring may be coupled between each torque arm 42*a*, 42*b* and the respective mount 46, biasing the ends of the torque arm that are remote from the mount 46 upwardly, away from the filter body 28.

Figure 6:
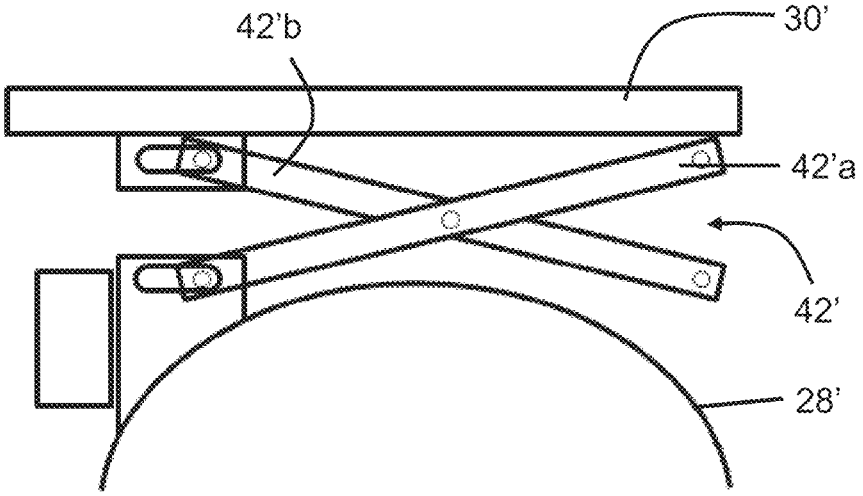
FIG. 6 is a schematic side view of an alternative filter of the filter arrangement of FIG. 1.

Other arrangements are envisaged in which the torque arms 42*a*, 42*b* take other positions or orientations relative to the filter body 28. For example, the torque arms 42*a*, 42*b* may alternatively be mounted to the closure plate 30, and in sliding communication with the filter body 28. The load-equalising mechanism 42 could alternatively take another form, provided that the means is capable of maintaining the orientation of the closure plate 30 relative to the filter body 28 during movement of the closure plate 30 towards and away from the filter body 28. For example, the load-equalising mechanism may be in the form of a scissor mechanism 42', as shown in FIG. 6. In this arrangement, two scissor arms 42'*a*, 42'*b* are provided, each being slidably and pivotably mounted to a respective one of the closure plate 30' and filter body 28', and being pivotably connected to the other.

To further guide the movement of the closure plate 30 relative to the filter body 28, the filter 18 additionally comprises alignment means. The alignment means takes the form of a number of rods 48 mounted to the closure plate 30, and complimentary elongate openings 50 in the filter body 28. In the depicted arrangement, four rods 48 are provided, each extending from a respective corner of the underside of the closure plate 30 towards the filter body 28. Similarly, four elongate openings 50 are provided, each being configured to receive a corresponding rod 48 in a relatively tight clearance fit.

With the filter 18 in position in the filter enclosure 22, both the rods 48 and the elongate openings 50 extend in the insertion direction I. As such, during relative movement between the closure plate 30 and the filter body 28, the rods 40 and, by association, the closure plate 30, are able to move only in the insertion and removal directions. This guards against any relative translational movement, or 'sliding', between the closure plate 30 and filter body 28 in a direction perpendicular to the insertion direction I.

Referring again to FIGS. 2 to 4B, the filter 18 and filter enclosure 22 comprise co-operating features to allow the filter 18 to be inserted into the filter enclosure 22 with ease. In particular, the filter 18 and filter enclosure 22 together define a keyway arrangement such that the filter 18 may only be received into the filter enclosure 22 in a single orientation. In the depicted embodiment, the keyway arrangement comprises two opposing elongate ribs 52 mounted to the filter body, and two complimentary elongate recesses, or channels 54 extending into the main body 12 of the vacuum cleaner 10 from the filter enclosure 22. Each rib 52 and channel 54 extends in a direction parallel with the insertion direction I. Each channel 54 extends downwardly from a first end 54*a* of the channel corresponding to the filter enclosure 22, while an elongate rib 52 is mounted to, or forms part of, each of the front and rear sides 32, 34 of the filter body 28. While the described arrangement comprises two elongate ribs 52 and two channels 54, it will be appreciated that any suitable number of ribs 52 and channels 54 may be used.

The enclosure opening has a central longitudinal axis A that is substantially perpendicular to the insertion direction I, extending from a front end to a rear end of the filter enclosure 22. When the filter 18 is in position in the filter enclosure 22 the keyway arrangement of ribs 52 and channels 54 is offset from this central longitudinal axis A at the enclosure opening 24. This can be seen in FIGS. 4A and 4B, for example, which show that the ribs 52 are offset towards the left-hand side 36 of the filter body 28. As such, there is only one position and orientation in which the filter 18 can be received by the filter enclosure 22, ensuring that the user can only insert the filter 18 into the enclosure 22 in the correct orientation for operation.

The keyway arrangement may alternatively, or additionally, take the form of one or more hooks mounted to and extending from the filter body 28, and receiving channels extending from the filter enclosure 22 into the main body 12 of the vacuum cleaner 10. The hooks may be positioned on the front side 32 of the filter body 28, and may extend in a direction that is transverse to the insertion direction I when the filter body 28 is in position in the filter enclosure 22, into the receiving channels. In this way, in this example, the filter may only be inserted into the filter enclosure 22 by aligning the hooks with the receiving channels and simultaneously inserting the hooks into the channels while the filter 18 is lowered into the filter enclosure 22.

In order to further increase the ease with which the filter 18 can be inserted into the enclosure 22, each channel 54 is tapered slightly from the first end 54*a*. A width of each channel 54, in a direction substantially perpendicular to the insertion direction I, is at a maximum at the first end 54*a* of the channel 54, and decreases until the tapered portion meets a narrower portion of constant width, where the width of the channel 54 substantially corresponds to the width of the corresponding rib 52. In this way, the user does not have to perfectly align the two ribs 52 of the filter body 28 with the corresponding channels 54 to insert the filter 18 into the filter body 28. Instead, provided that the user places each rib 52 at some position in the wider first end 54*a* of the corresponding channel 54, the rib 52 will then self-locate into the narrower portion as the filter 18 is inserted into the enclosure 22.

Figure 2:
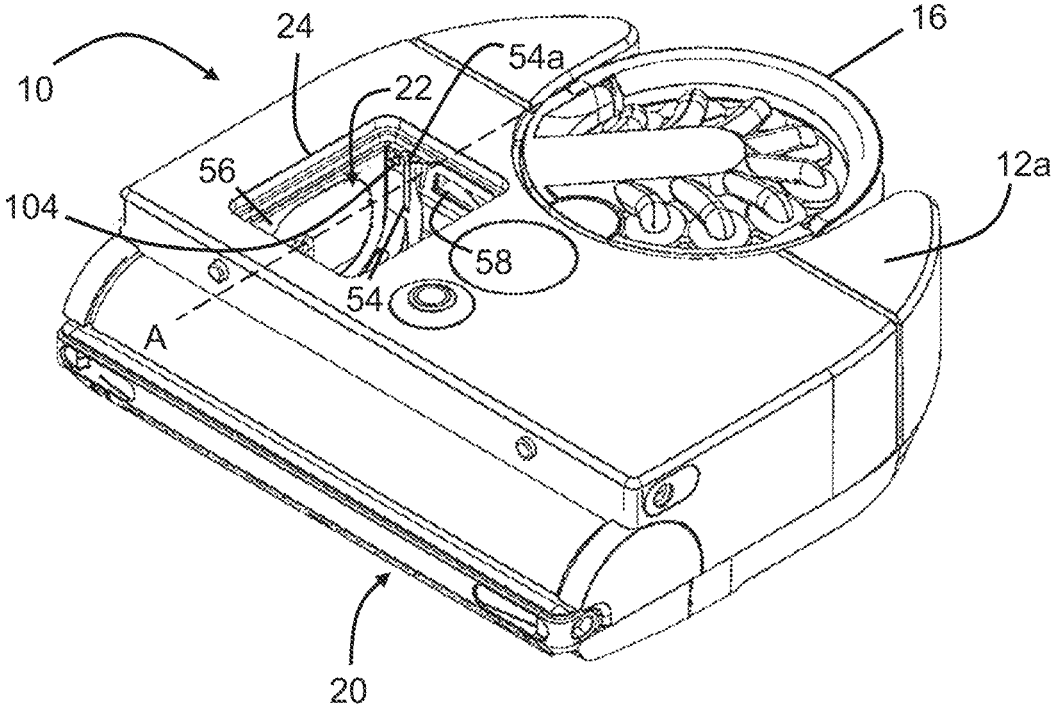
FIG. 2 is a perspective view of a filter enclosure of the filter arrangement of FIG. 1.

The filter enclosure 22 additionally comprises a flexible side wall 56, which can be seen in FIG. 2. The flexible side wall 56 of the enclosure 22 is biased towards the filter body 28 when the filter 18 is in position in the filter enclosure 22, and engages with the vertical left-hand side 36 of the filter body 28. As such, the filter 18 is supported in position in the filter enclosure 22, mitigating against relative movement between the filter 18 and enclosure 22 in a direction transverse to the insertion direction I. In addition, a seal is created between the flexible side wall 56 and the filter body 28, guarding against the unintentional release of gases from within the filter body 28 into the enclosure 22, and into the atmosphere. At the rear end of the filter enclosure 22, an enclosure inlet opening 58 is provided corresponding to the filter inlet opening of the filter body 28 and arranged to be aligned with the filter inlet opening 40 when the filter 18 is in position in the enclosure 22.

Figure 4A:
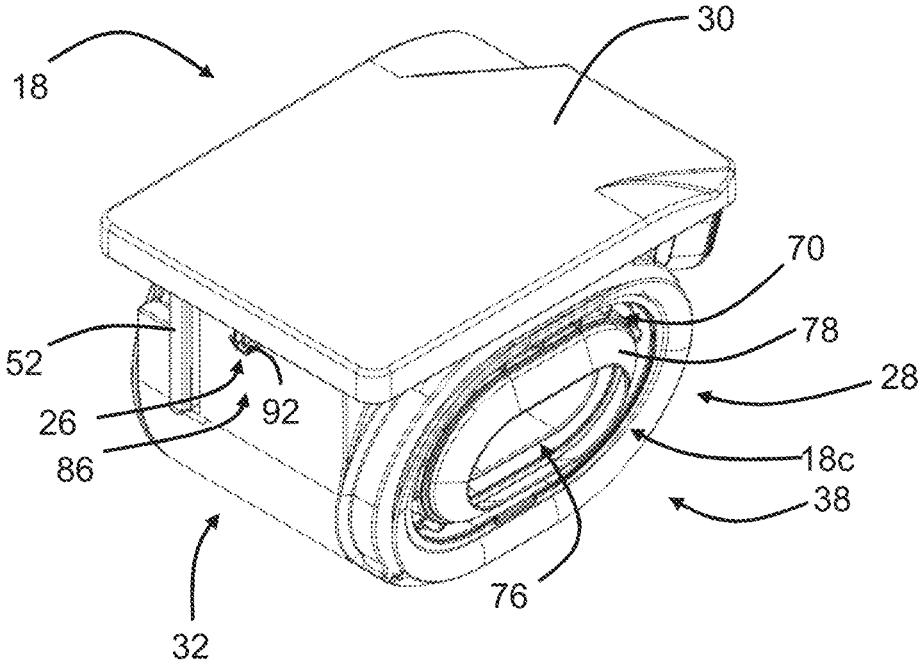
FIG. 4A is a perspective view of a filter of the filter arrangement of FIG. 1.
Figure 4B:
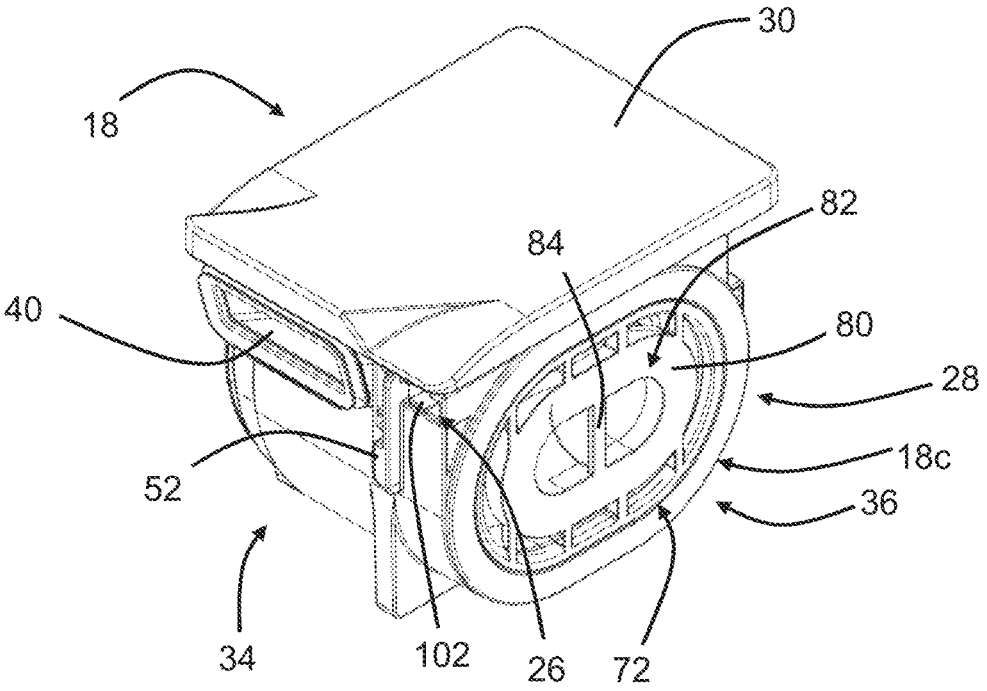
FIG. 4B is another perspective view of the filter of the filter arrangement of FIG. 1.
Figure 7:
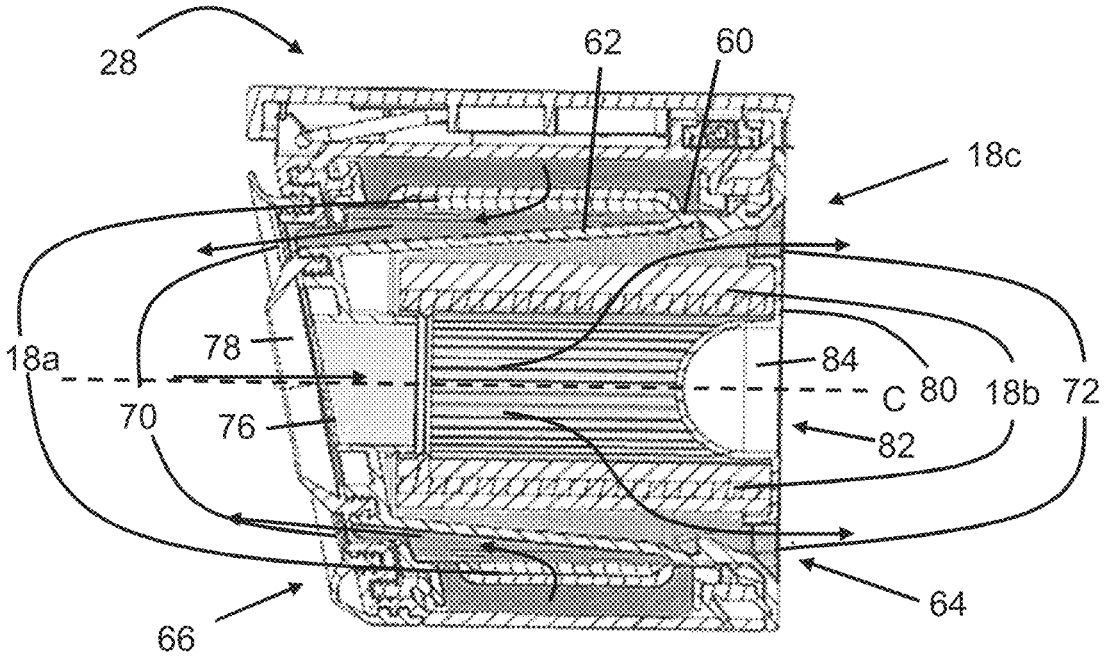
FIG. 7 is a section view of the filter of FIGS. 4A and 4B.

The specific arrangement of the pre- and post-motor filters 18*a*, 18*b* will now be described. As can be seen in FIGS. 4A, 4B and 7, the pre-motor filter 18*a* and post-motor filter 18*b* are coupled together to form a single unit, or filter unit 18*c*, housed within the filter body 28.

The pre- and post-motor filter 18*a*, 18*b* are each substantially annular in shape, and are concentrically arranged about a common axis C, such that the pre-motor filter 18*a* overlaps the post-motor filter 18*b* in a direction parallel with the common axis C. When the filter 18 is in position in the filter enclosure 22, the common axis C is substantially horizontal, and is substantially perpendicular to the insertion direction I. The pre-motor filter 18*a* is positioned radially outward of the post-motor filter 18*b*, in a direction perpendicular to the common axis C, such that the pre-motor filter 18*a* effectively surrounds the post-motor filter 18*b*.

The pre- and post-motor filters 18*a*, 18*b* therefore form a compact arrangement, and the overall size of the filter 18 can be minimised. This is advantageous from a packaging perspective, allowing the size and weight of the vacuum cleaner 10 to be reduced and/or freeing up space in the main body 12 of the vacuum cleaner 10 for other components.

The pre-motor filter 18*a* can be formed of any suitable filter material, or a combination of filter materials typically found in pre-motor filters. In the described arrangement, the pre-motor filter 18*a* comprises layers of filter media, including a layer of scrim or web material, a non-woven filter medium such as fleece, followed by a further layer of scrim or web material. An electrostatic filter medium could also be included if desired. The post-motor filter 18*b* can similarly be formed of any suitable filter material, or combination of materials, typically found in post-motor filters. In the present embodiment, the post-motor filter 18*b* is formed of a pleated HEPA-standard filter medium.

The pre-motor filter 18*a* is mounted to a first support frame 60 of the filter unit 18*c*, while the post-motor filter 18*b* is mounted to a second support frame 62 of the filter unit 18*c*, arranged to be received by, and mounted to, the first. As will be described in more detail below, the pre-motor filter 18*a*, post-motor filter 18*b* and first and second support frames 60, 62 are connected in such a way as to define a number of distinct channels, or pathways, for guiding air flowing through the filter unit 18*c*.

The filter unit 18*c* has a first end 64 corresponding to the left-hand side 36 of the filter body 28, when the filter unit 18*c* is in position in the filter body 28, and a second end 66 opposing the first, corresponding to the right-hand side 38 of the filter body 28. The second end 66 follows the shape of the right-hand side 38 of the filter body 28, and is therefore at a transverse angle to the insertion direction I. Similarly, the first end 64 is substantially vertical, parallel to the insertion direction I, in line with the left-hand side 36 of the filter body 28.

The second support frame 62 is positioned intermediate the pre- and post-motor filters 18*a*, 18*b* and is annular in shape, comprising a series of spaced-apart longitudinal ridges 68 (shown in FIG. 15) extending from the first end 64 of the filter unit 18*c* towards the second end 66. As the second support frame 62 extends towards the second end 66 it tapers towards the common axis C, such that the ridges 68 define separate sloping channels between the pre-motor filter 18*a* and the second support frame 62 for the passage of air. These channels terminate at the second end 66 of the filter unit 18*c* in a pre-motor outlet 70.

Radially inward of these sloping channels, the second support frame 62 and post-motor filter 18*b* define a substantially annular channel therebetween, which terminates in a filter outlet 72 at the first end 64 of the filter unit 18*c*. Radially inward still, the second support frame 62 and post-motor filter 18*b* together define a cylindrical channel extending through a central core of the filter unit 18*c*, which terminates in a post-motor inlet 76 at the second end 66. As can be seen in FIGS. 4A and 7, a seal 78 is provided at the second end 66 of the unit 18*c* to mitigate against any passage of air therethrough other than through the pre-motor outlet 70 or post-motor inlet 76.

At the first end 64 of the filter unit 18*c*, the second support frame 62 comprises an outer wall 80 having gripping means 82, to allow a user to remove the filter unit 18*c* from the filter body 28 and to handle the filter unit 18*c* with ease. In the depicted arrangement, the gripping means 82 takes the form of two recesses that are a mirror image of one another about an intermediate dividing wall 84. In particular, they are substantially hemispherical in cross-section taken parallel to the plane of the outer wall 80. The dividing wall 84 essentially forms a grip feature, which the user can pinch between a finger and thumb when they wish to extract the filter unit 18*c* from the filter body 28.

During operation of the vacuum cleaner 10, dirt-laden air is drawn into the cyclonrry, is separating unit 16 and dirt and debris are separated from the air. The air is subsequently expelled from the cyclonic separating unit 16 and flows through the enclosure inlet opening 58 and the adjoining filter inlet opening 40 to enter the filter unit 18*c*. The air is then drawn generally radially inwardly through the pre-motor filter 18*a*, which separates smaller dirt and dust particles from the air. The cleaner air flows along the channels between the pre-motor filter 18*a* and the second support frame 62 before passing out of the pre-motor outlet 70. After passing through the motor 14, the air is forced back into the filter unit 18*c* through the post-motor inlet 76 into the annular channel between the second support frame 62 and post-motor filter 18*b*. The air travels radially outwardly, though the post-motor filter 18*b* and is expelled from the filter unit 18*c* through the filter outlet 72, before being exhausted from the vacuum cleaner 10.

Positioning of the pre-motor filter 18*a* radially outward of the post-motor filter 18*b* advantageously ensures that the filter required to carry out the more significant cleaning operation also has the largest surface area.

The retention means 26 of the filter arrangement 17 will now be described in more detail, with reference to FIGS. 2 to 4B and 8. The retention means 26 comprises a first latching mechanism 86 associated with the closure plate 30, and a second latching mechanism 88 associated with the filter body 28.

Figure 3:
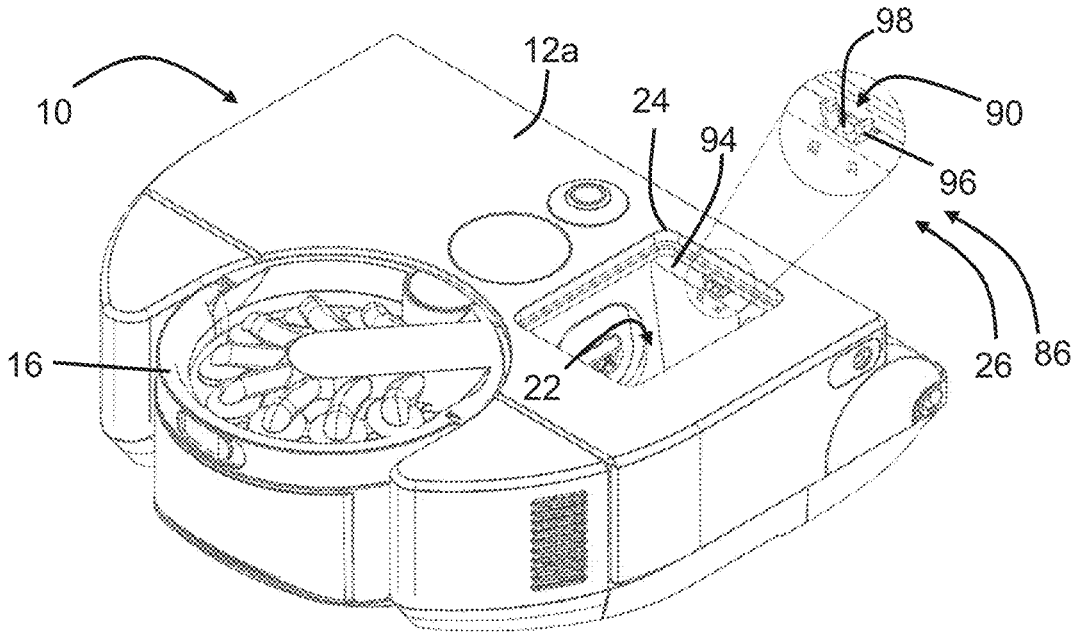
FIG. 3 is another perspective view of the filter enclosure of the filter arrangement of FIG. 1.

The first latching mechanism 86 is a two-state latching mechanism in the form of a conventional push-push latch, and comprises a receiving portion 90 and an activation pin 92 as can be seen in FIGS. 3 and 4A in particular. The filter enclosure 22 defines a shelf 94 at the front end, slightly offset from the enclosure opening 24 in the insertion direction I, and the receiving portion 90 of the first latching mechanism 86 is mounted in a substantially central position on this shelf 94. The activation pin 92, configured to operate the receiving portion 90, is mounted to, or is integral with, an underside of the closure plate 30 at the front end of the plate 30 and extends generally vertically in the insertion direction I. The receiving portion 90 and activation pin 92 are so-positioned that they are aligned when the filter 18 is inserted into the filter enclosure 22.

The receiving portion 90 comprises two receiving arms 96, each mounted either side of an activation button 98. Each arm 96 is pivotable relative to the activation button 98, such that upper ends of the arms 96 can be brought closer together or further apart depending on the state of the first latching mechanism 86. Each arm 96 comprises a protrusion at its upper end, such that it effectively forms a hook, capable of latching on to a complimentary protrusion formed at a lower end of the activation pin 92.

Operation, or activation, of the activation button 98 by the activation pin 92 causes the first latching mechanism 86 to change state, and for the receiving arms 96 to move position. In particular, if the arms 96 begin in a position in which they are spaced apart, operation of the activation button 98 by the pin 92 causes the arms 96 to move closer together, so that the arms 96 effectively embrace the activation pin 92. Subsequent operation of the button 98 causes the arms 96 to separate again, and so on.

With the closure plate 30 in the first position, the first latching mechanism 86 is in a latched state. In this state, the receiving arms 96 embrace the activation pin 92, and the protrusion of each arm 96 is hooked onto the complimentary protrusion of the pin 92. With the closure plate in the second position, the first latching mechanism 86 is in an unlatched state, and the receiving arms 96 are splayed apart at their upper ends, such that the activation pin 92 is released. The first latching mechanism 86 is activated by movement of the closure plate 30 relative to the filter body 28 between the first position and the depressed position, and between the second position and the depressed position.

Movement of the closure plate 30 relative to the filter body 28 additionally operates the second latching mechanism 88. This second latching mechanism 88 is at least partly visible in FIGS. 2, 4B, 5 and 8, and comprises a latch element 100, a latch member in the form of a latch bolt 102 and a complimentary recess 104 of the filter enclosure 22.

Figure 8:
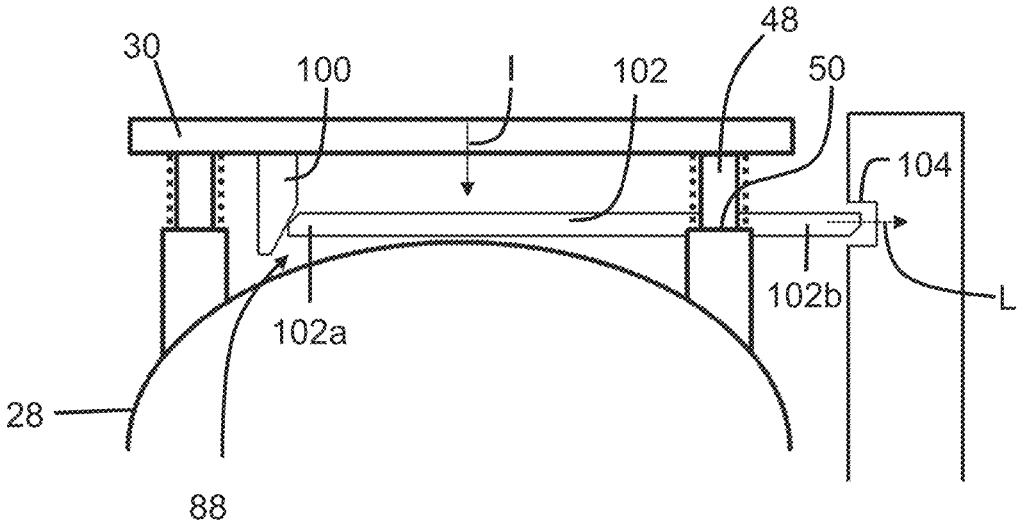
FIG. 8 is a schematic side view of the filter of FIGS. 4A and 4B, in which a closure plate of the filter is in a first position.

The latch element 100 is mounted to, or is integral with, the closure plate 30, and extends generally vertically in the insertion direction I from the underside of the closure plate 30, as can be seen in FIG. 8. The latch bolt 102 is itself carried in a track on the filter body 28, and is slidable relative to the filter body 28 during operation of the second latching mechanism 88. A lower end of the latch element 100, remote from the closure plate 30, is configured to engage a first end 102*a* of the latch bolt 102. In the depicted arrangement, the latch bolt 102 is substantially perpendicular to the latch element 100, such that the latch element 100 meets the latch bolt 102 at a right angle.

The latch element 100 is wedge-shaped at the lower end, and is provided with an angled lower surface. In other words, towards the lower end, the latch element 100 appears to taper and become narrower in a direction perpendicular to the insertion direction I. The first end 102*a* of the latch bolt 102 is provided with a corresponding angled surface, which is at broadly the same angle as, and is in sliding engagement with, the angled lower surface of the latch element 100. A second end 102*b* of the latch bolt 102, opposite to the first end 102*a*, is arranged to be received into the complimentary recess 104 of the filter enclosure 22, to engage with the enclosure 22 during movement of the latch bolt 102.

In use, when the closure plate 30 is moved relative to the filter body 28, the angled lower surface of the latch element 100 engages the corresponding angled surface of the latch bolt 102, staying in contact with the latch bolt 102 while moving relative thereto. When the closure plate 30 is moved in the insertion direction I, the angled lower surface of the latch element 100 progressively forces the latch bolt 102 outwardly, as the portion of the latch element 100 in contact with the bolt 102 increases in thickness. This drives the bolt 102 in a latching direction L perpendicular to the insertion direction I and into the corresponding recess 104 of the enclosure 22.

In reverse, when the closure plate 30 moves in the removal direction, the latch bolt 102 travels along the angled lower surface of the latch element 100 and, as the latch element 100 tapers and reduces in thickness, moves inwardly, in a withdrawal direction opposite to the latching direction L, retracting out of the recess 104 of the enclosure 22. To aid this inwards movement of the latch bolt 102, the bolt 102 is connected to a latch mount 106 provided on the filter body 28, and is biased relative to the latch mount 106. Specifically, a tension spring 108 is connected to the latch mount 106 at one end and the latch bolt 102 at the other, to bias the latch bolt 102 out of the recess 104 and out of engagement with the filter enclosure 22. When the closure plate 30 moves in the insertion direction I, the latch element 100 forces the latch bolt 102 to move against the force of the tension spring 108.

When the closure plate 30 is in the first position, the latch bolt 102 extends partway into the recess 104 of the filter enclosure 22, such that any movement of the filter body 28 relative to the filter enclosure 22 in the removal direction would cause the latch bolt 102 to contact the filter enclosure 22. In the depressed position, the latch bolt 102 extends fully into the recess 104 of the filter enclosure 22, such that any relative movement in the removal direction similarly causes contact between the latch bolt 102 and enclosure 22. The second latching mechanism 88 is therefore in a latched state in both the first position and the depressed position. However, when the closure plate 30 is in the second position, and is elevated above the enclosure opening 24, the second latching mechanism 88 is in an unlatched state, and the latch bolt 102 is fully withdrawn from the recess 104 of the enclosure 22, permitting removal of the filter body 28 from the filter enclosure 22 in the removal direction.

While the retention means 26 has been described as comprising both the first 86 and the second 88 latching mechanisms, other arrangements are envisaged in which the second latching mechanism 88 is omitted, and only the first latching mechanism 86 is used to releasably retain the filter 18 in the filter enclosure 22.

The following passages describe the typical sequence of steps carried out by a user, when maintenance of the filter unit 18*c* is necessary. Reference is made to FIGS. 8 to 15.

As has been mentioned previously, during normal operation of the vacuum cleaner 10 the filter 18 is positioned inside the filter enclosure 22, and the closure plate 30 is in the first position, in which it sits substantially flush with the upper surface of the main body 12 of the vacuum cleaner 10. In this position, the first 86 and second 88 latching mechanisms are each in their respective latched states.

In terms of the first latching mechanism 86, with the closure plate 30 in the first position, the receiving arms 96 of the receiving portion 90 embrace the activation pin 92, hooking the protrusion of the activation pin 92 and guarding against movement of the closure plate 30 out of the filter enclosure 22 in the removal direction. In terms of the second latching mechanism 88, the second end 102*b* of the latch bolt 102 protrudes partway into the complimentary recess 104 of the filter enclosure 22 under the action of the latch element 100, guarding against movement of the filter body 28 out of the filter enclosure 22 in the removal direction.

Figure 9:
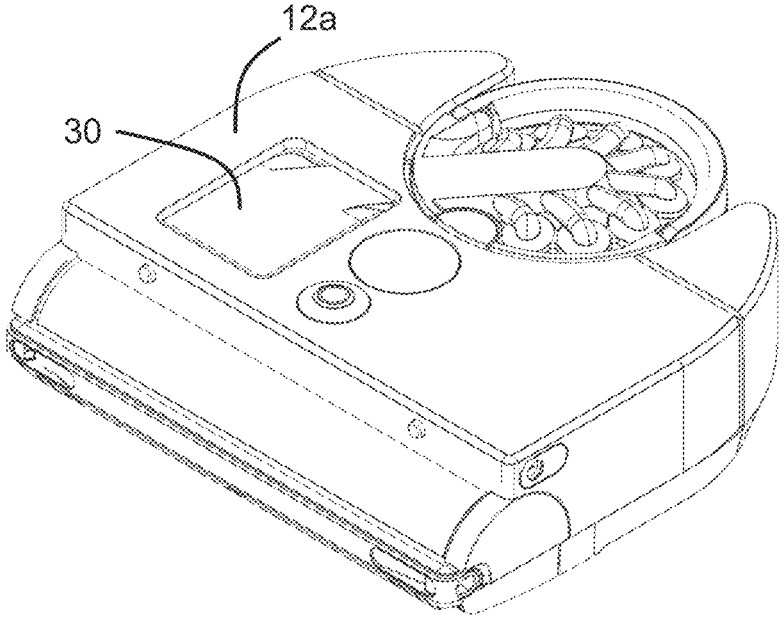
FIG. 9 is a perspective view of the vacuum cleaning appliance of FIG. 1, comprising the filter of FIGS. 4A and 4B, showing a closure plate of the filter in a depressed position.

When it is desired for the filter 18 to be removed from the filter enclosure 22, the user can push down at any position on the closure plate 30, until the closure plate 30 is in the depressed position. In this depressed position, the closure plate 30 is at the limit of travel in the insertion direction I relative to the filter body 28, and is depressed below the upper surface 12*a* of the main body 12, as is shown in FIG. 9. As the closure plate 30 takes the depressed position, the activation pin 92 contacts and depresses, or operates, the activation button 98.

Upon operation of the activation button 98, the button 98 may 'click', providing the user with haptic, or tactile, feedback that the button 98 has been successfully operated. The user then releases pressure on the closure plate 30, which is biased in the removal direction, towards the second position. The closure plate 30 moves away from the filter body 28 under the action of the compression spring 44, the activation button 98 is released and the receiving arms 96 separate, thereby releasing the activation pin 92 and unlatching the first latching mechanism 86. The closure plate 30 is urged by the compression spring 44 into the second position.

Figure 10:
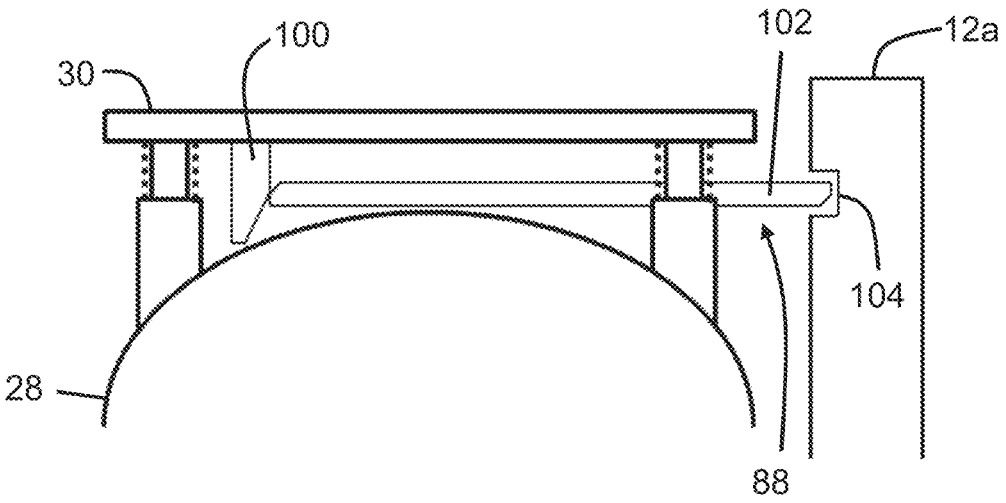
FIG. 10 is a side view of the filter of FIGS. 4A and 4B, in which the closure plate is in the depressed position.

The second latching mechanism 88 is unlatched simultaneously. As the closure plate 30 takes the depressed position, the latch bolt 102 is forced by the latch element 100 further into the complimentary recess 104 of the filter enclosure 22, as shown in FIG. 10. As the user subsequently releases pressure on the closure plate 30, the latch element 100 moves in the withdrawal direction, away from the filter body 28, and the latch bolt 102 is urged by the tension spring 108 out of the complimentary recess 104 of the filer enclosure 22.

Figure 11:
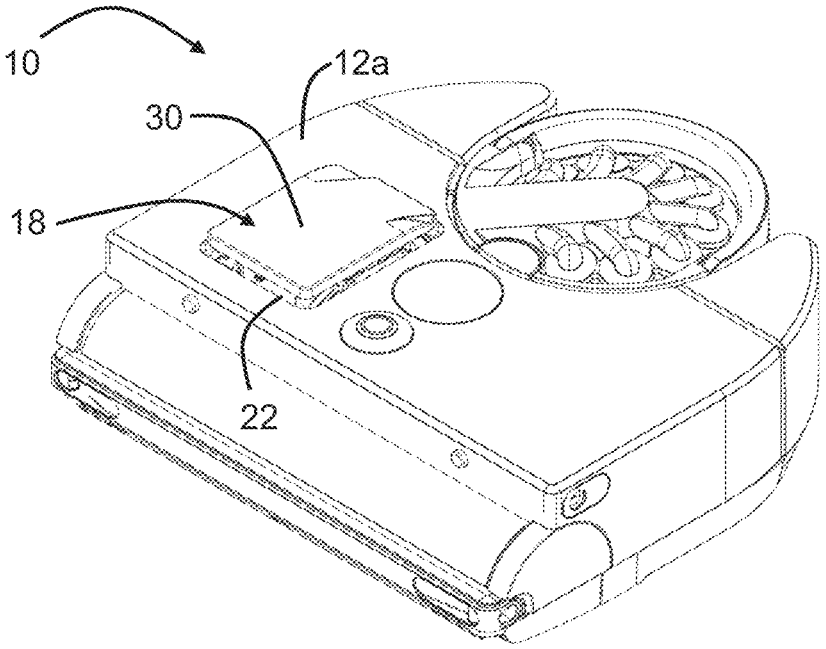
FIG. 11 is a perspective view of the vacuum cleaning appliance of FIG. 1, comprising the filter of FIGS. 4A and 4B, showing a closure plate of the filter in a second position.
Figure 12:
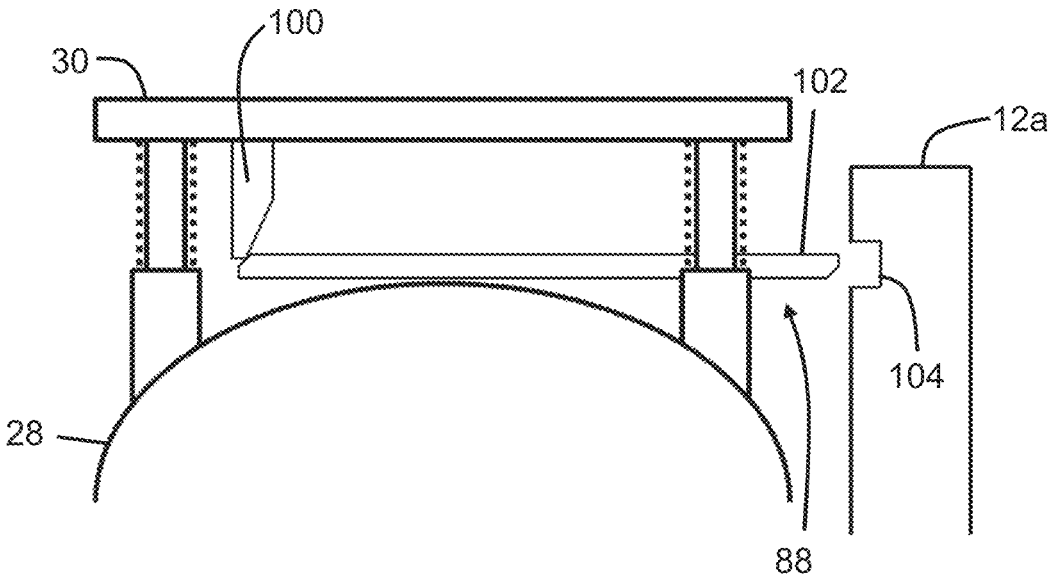
FIG. 12 is a side view of the filter of FIGS. 4A and 4B, in which the closure plate is in the second position.

When the closure plate 30 is in the second position, shown in FIGS. 11 and 12, the entire plate 30 is elevated above, and spaced slightly apart from, the upper surface 12*a* of the main body 12 of the vacuum cleaner 10. This permits a user to grasp the sides and/or underside of the closure plate 30 for removing the filter 18 from the filter enclosure 22. In this second position, the receiving arms 96 of the first latching mechanism 86 are still spaced apart in the unlatched position, while the latch bolt 102 is fully withdrawn from the complimentary recess 104 of the filter enclosure 22. As such, the first 86 and second 88 latching mechanisms are each in their respective unlatched states.

Figure 13:
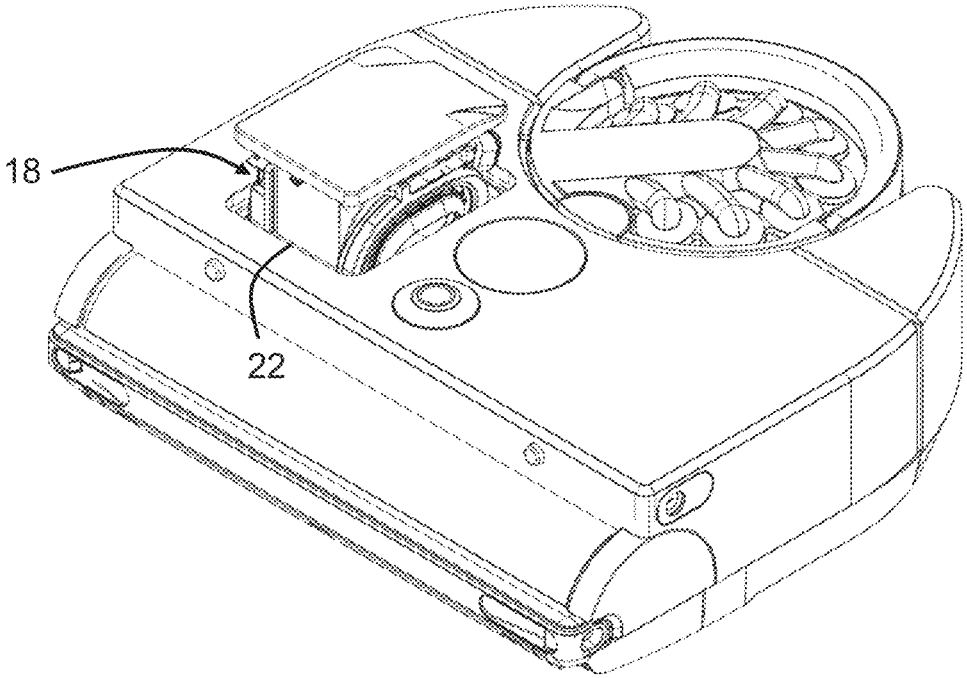
FIG. 13 is a perspective view of the vacuum cleaning appliance of FIG. 1, showing the filter of FIGS. 4A and 4B partially removed from the filter enclosure of FIGS. 2 and 3.
Figure 14:
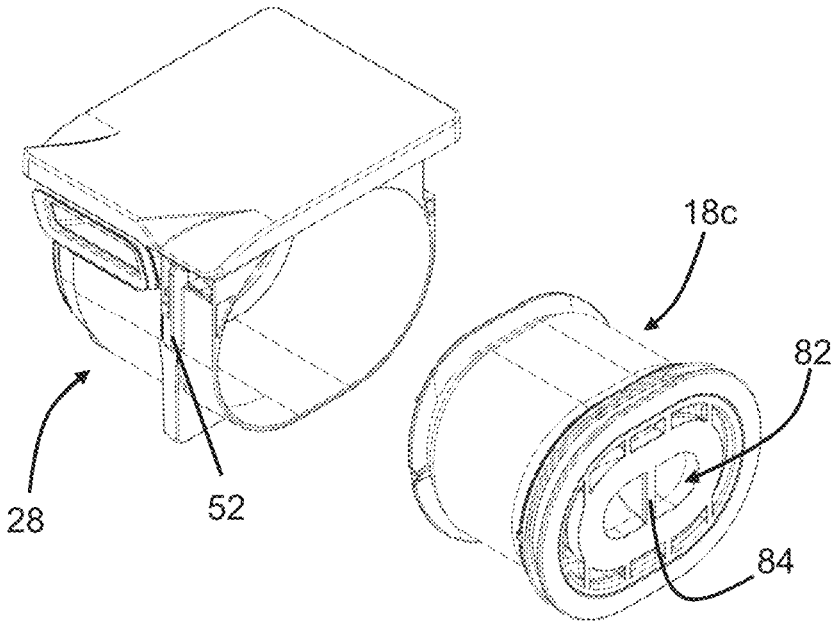
FIG. 14 is a perspective view of the filter of FIGS. 4A and 4B, with a filter unit of the filter separated from the filter body of FIG. 5.
Figure 15:
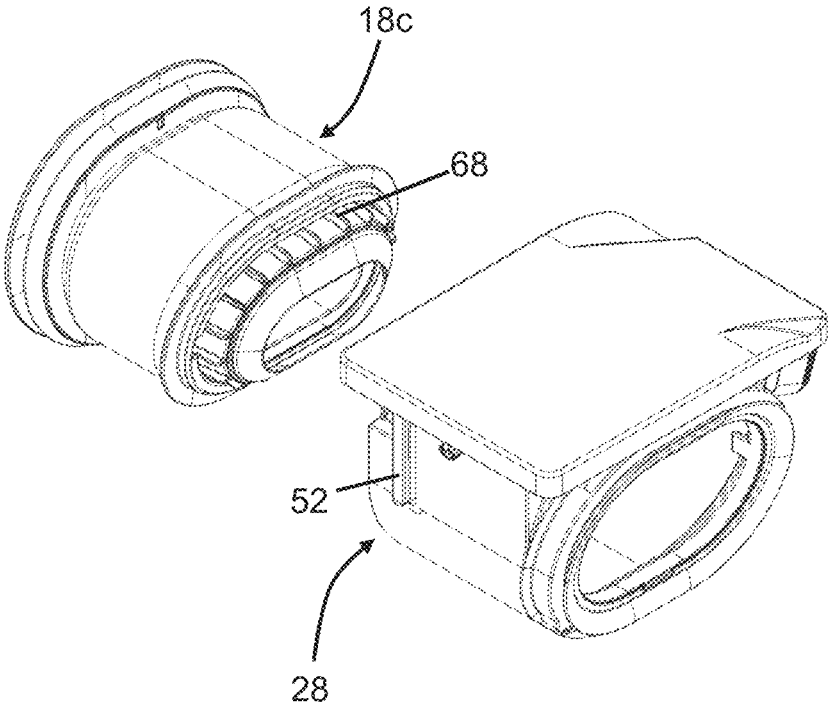
FIG. 15 is another perspective view of the filter of FIGS. 4A and 4B, with the filter unit of the filter separated from the filter body of FIG. 5.

From this position, the user can remove the filter 18 from the filter enclosure 22 in the removal direction, as shown in FIG. 13, before grasping the dividing wall 84 of the filter unit gripping means 82, and extracting the filter unit 18*c* from the filter body 28 in the manner shown in FIGS. 14 and 15. The user is then free to wash the pre- and post-motor filters 18*a*, 18*b*, or to replace the filters, if required.

Once any maintenance activities on the filter unit 18*c* are completed, the filter 18 can be reinserted into the filter enclosure 22 by broadly reversing the sequence of steps taken to remove the filter 18.

In brief, the user aligns the elongate ribs 52 of the filter body 28 with the complimentary channels 54 that extend from the enclosure opening 24, and inserts the filter 18 into the filter enclosure 22 in the insertion direction I. Without any pressure applied to the closure plate 30, once the filter body 28 reaches a base of the filter enclosure 22, the closure plate 30 sits in the second position, raised slightly above the upper surface 12*a* of the vacuum cleaner main body 12. In this position, the first 86 and second 88 latching mechanisms are in their respective unlatched states.

The user then applies pressure to the closure plate 30 in the insertion direction, pushing the closure plate 30 down towards the depressed position, such that the activation pin 92 of the closure plate 30 contacts the activation button 98 of the receiving portion 90. Upon depression of the button 98, the user again experiences feedback, indicating that the button 98 has been successfully operated, and the receiving arms 96 move towards one another. In this depressed position, the protrusion of the activation pin 92 still sits beneath the protrusions of the receiving arms 96, so that the pin 92 can still move a short way relative to the arms 96 in the removal direction.

Under the action of the compression spring, the closure plate 30 moves slightly away from the filter body 28, into the first position, in which the protrusion of the activation pin 92 is in contact with the protrusion of the receiving arms 96, and the activation pin 92 is hooked by the receiving arms 96.

The second latching mechanism 88 is again operated simultaneously with the first. When the closure plate 30 is pushed down towards the depressed position, the latch element 100 of the second latching mechanism 88 travels in the insertion direction I, forcing the latch bolt 102 to move in a perpendicular direction, against the action of the tension spring 108, into engagement with the complimentary recess 104 of the enclosure 22. With the closure plate 30 in the depressed position, the latch bolt 102 is at the limit of its travel into the complimentary recess 104.

When the closure plate 30 subsequently moves into the first position, the latch bolt 102 retracts slightly, but remains in the complimentary recess 104 of the filter enclosure. With the closure plate 30 back in the first position, each of the first 86 and second 88 latching mechanisms are therefore in their respective latched states, and neither the closure plate 30 nor the filter body 28 is able to move relative to the filter enclosure 22 in the removal direction.

Many modifications may be made to the above examples without departing from the scope of the present invention as defined in the appended claims.

Figure 16:
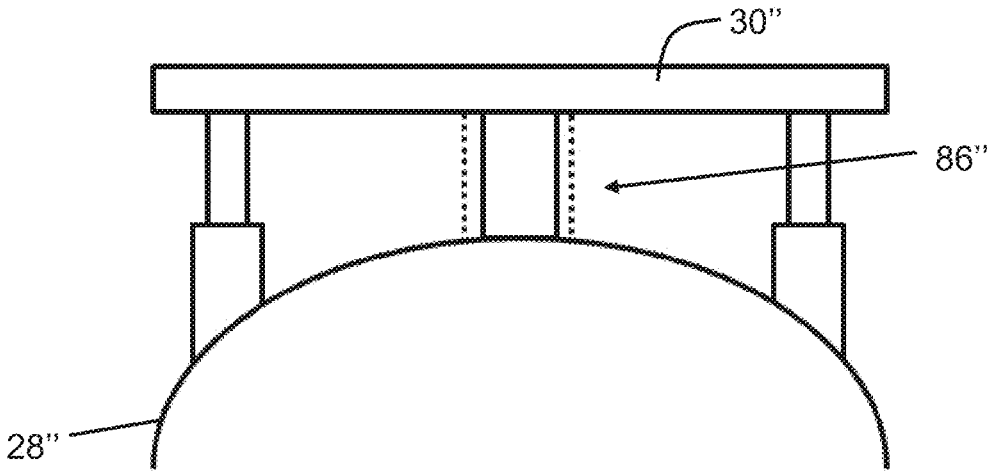
FIG. 16 is a schematic side view of an alternative filter arrangement.

For example, while the receiving portion of the first latching mechanism 86" has been described as being mounted on a shelf of the filter enclosure, the receiving portion may alternatively be positioned on an upper surface of the filter body 28", as shown in FIG. 16. In this case, when the closure plate 30" is in the first position and is moved in the insertion direction I", the activation pin mounted to the closure plate 30" operates the receiving portion mounted to the filter body 28" in the same manner as previously described. In this way, the first latching mechanism 86" is configured to latch and unlatch the closure plate 30" to and from the filter body 28".

Figure 17:
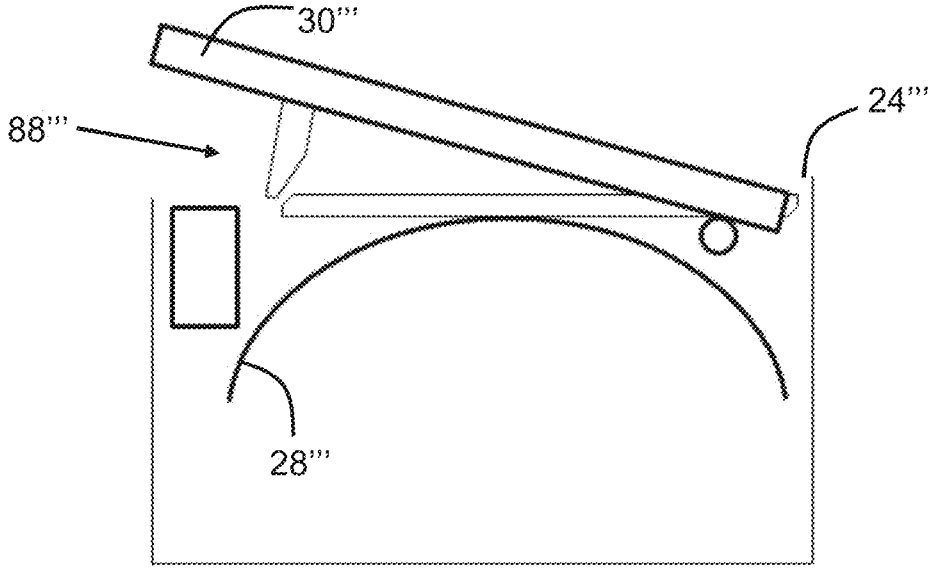
FIG. 17 is a schematic side view of another alternative filter arrangement.

The closure plate may alternatively or additionally be pivotably mounted to the filter body 28'", at the front end of the closure plate 30'", for example. In this example, with the closure plate 30'" in the first position, the closure plate 30'" still sits substantially flush with the upper surface 12*a*'" of the main body 12'", while in the second position only a rear end of the closure plate 30'" is elevated above the enclosure opening 24'", as depicted in FIG. 17. Other features of the arrangement may substantially correspond to those features described previously, with the latch element of the second latching mechanism 88—extending from the underside of the closure plate 30'" at the rear end thereof.

In another arrangement (not shown), the closure plate 30 may not be connected to the filter body 28, and may therefore be removed from the filter enclosure 22 independently of the filter body 28. In this arrangement, the first 86 and/or second 88 latching mechanism may operate substantially as has been described herein, such that when the closure plate 30 is moved from the first position or the second position into the depressed position, the retention means 26 is operated. In this example, the closure plate 30 may be biased into the second position relative to the filter enclosure 22 or to the main body 12 of the vacuum cleaner 10. Once in the second position, the closure plate 30 can be removed from the filter enclosure 22, allowing subsequent access to, and removal of, the filter body 28.

Figure 18:
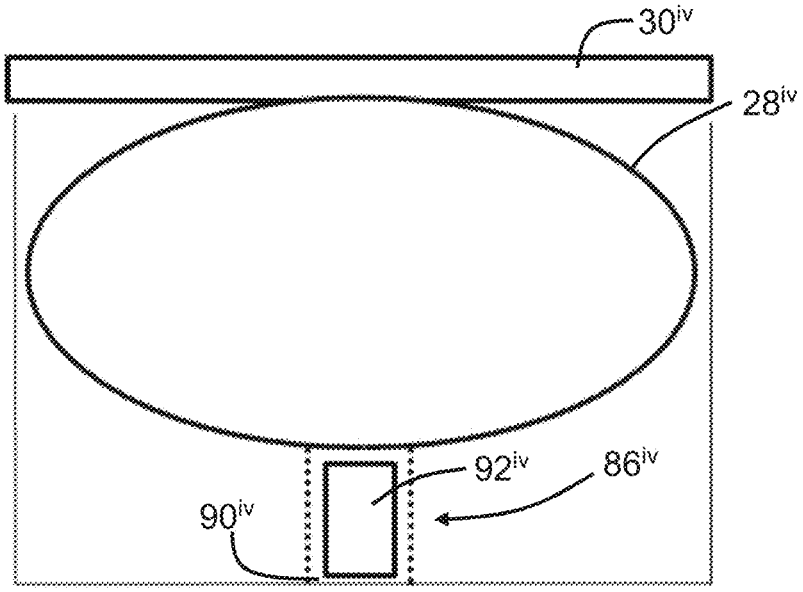
FIG. 18 is a schematic side view of another alternative filter arrangement.

As has been mentioned previously, arrangements are also envisaged in which the actuation portion $30^{iv}$ forms part of the filter body $28^{iv}$, and in which the first $86^{iv}$ and second latching mechanisms may be associated with the filter body $28^{iv}$. In addition, or as an alternative, the receiving portion $90^{iv}$ of the first latching mechanism $86^{iv}$ may be mounted to the base of the filter enclosure $22^{iv}$, while the activation pin $92^{iv}$ extends from a base of the filter body $28^{iv}$, as is shown in FIG. 18.

While arrangements have been described in which the first latching mechanism 86 is a single two-state latching mechanism, it is envisaged that any suitable number of two-state latching mechanisms may be used. For example, it is envisaged that the first latching mechanism 86 may comprise two two-state latching mechanisms, with one at each of the front and rear end of the closure plate 30. In this arrangement, both two-state latching mechanisms can be operated simultaneously by moving the closure plate 30 in the insertion direction I.

Figure 19:
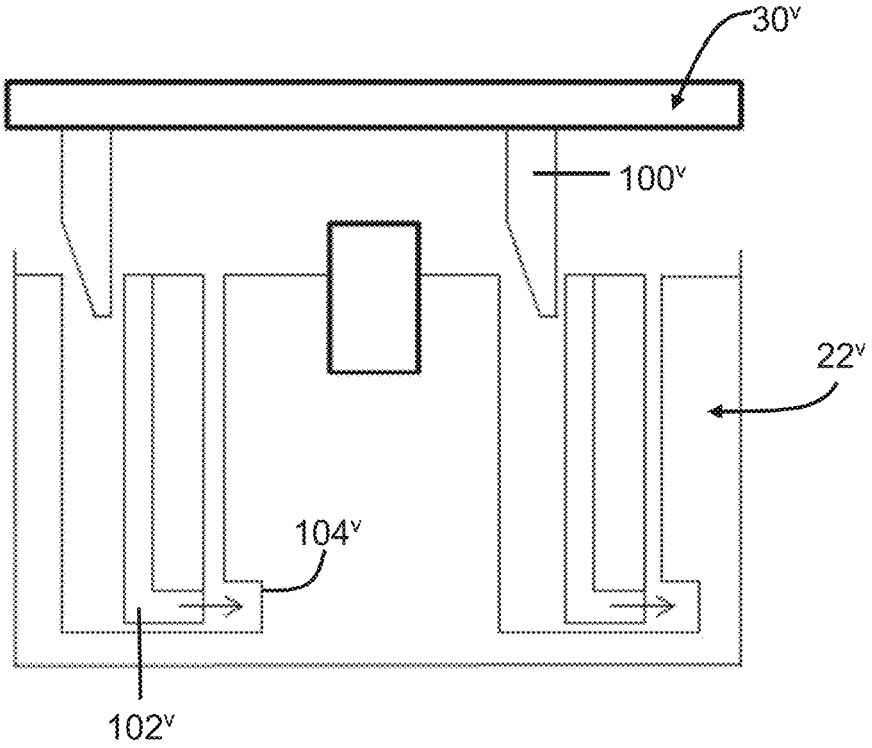
FIG. 19 is a schematic side view of another alternative filter arrangement.

Turning now to FIG. 19, the latch bolt of the second latching mechanism has been described herein as being slidable relative to the filter body. However, it is envisaged that the latch bolt 102" may instead form part of the filter body (not shown), such that the filter body is itself forced into engagement with the filter enclosure 22" when the closure plate 30" is moved in the insertion direction I. For example, there may in fact be two latch bolts 102" fixedly mounted to, or forming part of, the filter body, extending generally in the insertion direction I on the front side of the filter body and being received in complimentary recesses 104" of the filter enclosure 22". In this example, the closure plate 30" similarly comprises two wedge-shaped latch elements 100" extending from the underside of the closure plate 30".

Upon depression of the closure plate 30" in the insertion direction I, the latch elements 100" enter the complimentary recesses 104" and an angled lower surface of each latch element 100" contacts the filter enclosure 22". When the closure plate 30" is depressed further in the insertion direction I, the angled lower surfaces slide relative to the filter enclosure 22", forcing the members 100" outwardly in a direction perpendicular to the insertion direction I as the thickness of each member increases, and into contact with the latch bolts 102". Further insertion causes the latch elements 100" to urge the latch bolts 102" into engagement with the complimentary recesses 104". It is envisaged that another wedge-shaped latch element may drive the latch bolts 102" in a reverse direction, out of engagement with the recesses 104", when the closure plate 30" moves in the removal direction.

The invention claimed is:

1. A filter arrangement for a vacuum cleaning appliance, comprising:

a filter enclosure having an enclosure opening;

a filter configured to be received through the enclosure opening into the filter enclosure in an insertion direction; and retention means operable between latched and unlatched states for releasably retaining the filter in the filter enclosure, wherein the filter includes an actuation portion configured to operate the retention means, wherein the actuation portion is moveable between at least first and second positions and is biased towards the second position, wherein, when the filter is in the filter enclosure, movement of the actuation portion in the insertion direction from the first position to a depressed position transitions the retention means to the unlatched state, whereinafter the actuation portion is moved to the second position in which at least a part of the actuation portion is elevated above the enclosure opening.

2. The filter arrangement of claim 1, wherein the actuation portion closes the enclosure opening when in the first position.

3. The filter arrangement of claim 1, wherein the filter further includes a filter body, and wherein the actuation portion is movable relative to the filter body.

4. The filter arrangement of claim 3, wherein the retention means includes a first latching mechanism associated with the actuation portion and a second latching mechanism associated with the filter body.

5. The filter arrangement of claim 4, wherein the first latching mechanism includes a two-state latching mechanism which is activated by movement of the actuation portion relative to the filter body between the first position and the depressed position.

6. The filter arrangement of claim 4, wherein the second latching mechanism includes a latch member carried on the filter body which is engageable with the filter enclosure, wherein movement of the actuation portion relative to the filter body between the first position and second position causes movement of the latch member.

7. The filter arrangement of claim 6, wherein movement of the actuation portion relative to the filter body from the first position to the second position causes retraction of the latch member towards the filter body, out of engagement with the filter enclosure.

8. The filter arrangement of claim 6, wherein movement of the latch member is in a direction that is transverse to the movement of the actuation portion.

9. The filter arrangement of claim 3, wherein the filter comprises alignment means configured to guide the movement of the actuation portion relative to the filter body.

10. The filter arrangement of claim 3, wherein the actuation portion has a plan profile that substantially corresponds to a plan profile of the filter body.

11. The filter arrangement of claim 3, wherein the actuation portion is moveably suspended relative to the filter body by a load-equalising mechanism that is configured to maintain the orientation of the actuation portion relative to the filter body during movement of the actuation portion.

12. The filter arrangement of claim 11, wherein the load-equalising mechanism comprises a pair of torque arms, a first torque arm of the pair being transverse to a second torque arm of the pair.

13. The filter arrangement of claim 1, wherein the filter and the filter enclosure define a keyway arrangement such that the filter may only be received into the filter enclosure in a single orientation.

14. The filter arrangement of claim 1, wherein the filter comprises a first filter and a second filter.

15. The filter arrangement of claim 14, wherein the first filter and the second filter are annular about a common axis.

16. A vacuum cleaning appliance comprising the filter arrangement of claim 1.

* * * * *